US009687049B2

(12) United States Patent
Dhubb

(10) Patent No.: US 9,687,049 B2
(45) Date of Patent: Jun. 27, 2017

(54) ZIPPER REPAIR TOOL

(71) Applicant: Belinda Dhubb, Brampton (CA)

(72) Inventor: Belinda Dhubb, Brampton (CA)

( * ) Notice: Subject to any disclaimer, the term of this patent is extended or adjusted under 35 U.S.C. 154(b) by 153 days.

(21) Appl. No.: 14/058,351

(22) Filed: Oct. 21, 2013

(65) Prior Publication Data

US 2014/0109366 A1 Apr. 24, 2014

Related U.S. Application Data

(60) Provisional application No. 61/717,792, filed on Oct. 24, 2012.

(51) Int. Cl.

| | |
|---|---|
| ***A44B 19/00*** | (2006.01) |
| ***B25B 7/02*** | (2006.01) |
| ***B26B 17/00*** | (2006.01) |
| ***B25B 7/00*** | (2006.01) |

(52) U.S. Cl.

CPC ..... *A44B 19/00* (2013.01); *B25B 7/00* (2013.01); *B25B 7/02* (2013.01); *B26B 17/00* (2013.01); *Y10T 29/5101* (2015.01)

(58) Field of Classification Search

CPC ..... B26B 13/06; B26B 13/08; B26B 13/10; B26B 17/00; B26B 17/003; B26B 17/006; B26B 17/02; B25B 7/00; B25B 7/02

USPC ..... 30/175, 178, 179, 186–190, 225, 229, 30/230, 233, 244, 254–262

See application file for complete search history.

(56) References Cited

U.S. PATENT DOCUMENTS

| | | | | |
|---|---|---|---|---|
| 1,107,210 | A * | 8/1914 | Adams | 81/9.4 |
| 1,442,486 | A * | 1/1923 | Looke | 72/409.19 |
| D152,927 | S | 3/1949 | Stern | |
| 2,818,755 | A | 1/1958 | Kahn | |
| 3,218,696 | A | 11/1965 | Dritz | |
| 3,461,713 | A * | 8/1969 | Donath | A44B 19/00 72/409.01 |
| 4,229,881 | A * | 10/1980 | Troxel | 30/254 |
| 4,246,698 | A * | 1/1981 | Lasner et al. | 30/134 |
| 4,815,210 | A * | 3/1989 | Burrage | 30/176 |
| 5,168,629 | A * | 12/1992 | Willard | B25G 1/102 30/231 |
| 6,049,985 | A * | 4/2000 | Gonzalez et al. | 30/233 |
| 6,839,949 | B1 | 1/2005 | Miknich | |
| 7,424,838 | B2 * | 9/2008 | Li | B25B 7/22 7/129 |
| 8,365,418 | B2 * | 2/2013 | Tomasetti et al. | 30/286 |

(Continued)

*Primary Examiner* — Jason Daniel Prone
*Assistant Examiner* — Richard Crosby, Jr.
(74) *Attorney, Agent, or Firm* — Global Intellectual Property Agency, LLC; Daniel Boudwin

(57) ABSTRACT

The present invention describes a tool for fixing a zipper. The present invention resembles a pliers-like device and comprises a pair of pivotally connected handles that terminate in jaws. The jaws include a bifurcated end for the reception of a zipper head and a blade configured for severing a sewing thread. The handle of the tool includes an interior compartment having sunken sections formed therein for supporting sewing needles and threads used for repairing zippers and fabric items. This provides users with a convenient and quick way to fix a loose zipper, enables individuals to easily repair torn or frayed material, and prevents people from damaging the material around a zipper when trying to fix a loose example thereof.

4 Claims, 5 Drawing Sheets

(56) References Cited

U.S. PATENT DOCUMENTS

| | | | | |
|---|---|---|---|---|
| 8,443,518 | B2 * | 5/2013 | Fisher | B26B 15/00 30/2 |
| 9,242,360 | B2 * | 1/2016 | Gresham | B25F 1/006 |
| 2002/0178875 | A1 * | 12/2002 | Lin | B25F 1/006 81/437 |
| 2004/0065178 | A1 * | 4/2004 | Anderson | B25B 23/12 81/177.4 |
| 2006/0075642 | A1 * | 4/2006 | Elkins | 30/233 |
| 2007/0240316 | A1 * | 10/2007 | Yu et al. | 30/254 |
| 2010/0037465 | A1 * | 2/2010 | Price | 30/152 |
| 2010/0212162 | A1 * | 8/2010 | Ronan | 30/122 |
| 2012/0000019 | A1 * | 1/2012 | Steele et al. | 7/107 |

* cited by examiner

ZIPPER REPAIR TOOL

CROSS REFERENCE TO RELATED APPLICATION

This application claims the benefit of U.S. Provisional Application No. 61/717,792 filed on Oct. 24, 2012, entitled "Carry-All Zipper Fixer-Upper." The above identified patent application is herein incorporated by reference in its entirety to provide continuity of disclosure.

BACKGROUND OF THE INVENTION

Field of the Invention

The present invention relates to pliers. More specifically the invention relates to a pair of pliers adapted for receiving a zipper head, which further comprises a storage compartment within the tool handle configured for the storage of needles and thread therein.

Zippers have been used for many years and provide closure to a variety of devices by using interlocking teeth. This style of closure is typically used to increase or decrease the size of an opening in a bag or clothing, to join together two sides of a jacket, or to attach or detach one portion of a garment from another.

A zipper includes two parallel rows of teeth, top and bottom stops, a zipper head, parallel rows of tape, and a pull tab. The tape is placed on either side of the openings of a jacket, pair of pants, bag, or luggage and the teeth are secured thereon. The opening is closed and opened by pulling the pull tab and moving the zipper head along the rows of the teeth. A Y-shaped channel inside the sliding zipper head interlocks the two rows of teeth together or separates them depending on the direction the slider is pulled. In most cases, the zipper completely opens or closes an opening when the zipper is at its upper or lowermost position.

Zippers are relatively simple devices that provide a closure to garments, however, when a zipper fails the garment is sometimes rendered unusable or at least un-securable. Common problems that arise include when the sliding zipper head becomes loosened or removed. A misalignment in the zipper head in relation to the teeth prevents the slider from properly interlocking the teeth, and prevents the sliding zipper head from joining the two sides together, thus preventing closure of the garment.

When damage to a zipper head renders a garment unusable, the options are to repair or replace the garment, which can be very costly. There are several devices that attempt to repair a damaged zipper. These devices are provided in the form of hand tools having a pliers-like body and a special head portion. The head portion of the pliers is configured for holding the head of a zipper while the user either sews or clamps the zipper head in place. The drawback of these devices is that they often fail to provide a mechanism or compartment within the handle of the pliers that is configured for holding a needle and thread. Having a single device that contains a needle, thread, and pliers is desirable because all the tools are required for repairing a zipper and having them in one location prevents misplacement of the required tools.

The present invention relates to a pliers-like device that is configured for repairing a zipper. The device includes a pliers-like body having a pair of hingedly attached handles that terminate in a pair of jaw sections. The jaw sections include a forked end for zipper head repair and a cutting edge for assisting in sewing repairs. The forked end is configured for holding a portion of a zipper head, and the blade portion of the head section is configured for cutting thread. The present invention differs from the known devices in that it provides a specialized compartment for the storing of the tools that are necessary for repairing a zipper. One of the handles includes an compartment that has sunken sections sized and configured for storing items such as threads and needles. The present invention serves to enable a person to have a device that is capable of providing all of the tools necessary repairing a zipper.

Description of the Prior Art

Devices have been disclosed in the prior art that relate to zipper repair devices. These include devices that have been patented and published in patent application publications. These devices generally relate to pliers-like devices that are adapted to hold a zipper section. The following is a list of devices deemed most relevant to the present disclosure, which are herein described for the purposes of highlighting and differentiating the unique aspects of the present invention, and further highlighting the drawbacks existing in the prior art.

Devices in the prior art largely relate to pliers-like devices that include jaws adapted for holding a zipper head, however, having only adapted jaws equipped on the pliers-like device is limiting. The present invention provides an improved device that further includes the accessories necessary to repair the zipper located within the handle of the zipper repair tool.

One such device in the prior art is U.S. Design Pat. No. 152,927 to Stern, which illustrates a zipper repair tool, however, the zipper repair tool of Stern differs from that of the present invention in that it fails to provide a forked leading end and a compartment capable of storing a needle and thread.

Another patent, U.S. Pat. No. 2,818,755 to Kahn teaches a zipper repair tool, and particularly to a tool for meshing a zipper incident to its repair where the zipper is provided with coextensive pressure-sealing ribs of rubber or similar material. When the zipper is to be meshed, the assembly is clamped downwardly on the top of the zipper with firm pressure, and the tool is pulled along the zipper, causing the zipper to mesh. However, while Khan teaches a zipper repair tool that is similar in nature and relevant to the present invention, it differs in that it fails to provide a forked end and further differs in that it fails to provide a storage compartment for needles and thread.

U.S. Pat. No. 3,218,696 to Dritz teaches a tool resembling a pliers-like device for removing a slider element from a zipper. In use, an offset is placed against the neck of the zipper slider and a wedge is placed between the track of the zipper and one of the wings of the zipper slider. When the jaws of the tool are brought together the wings of the zipper are pried apart and the zipper is removed. Although the tool of Dritz is similar in nature and relevant to the present invention, it differs in that it fails to provide a compartment within the handles of the tool that is configured for storing a needle and thread to facilitate the repair of the zipper.

Yet another prior art example is U.S. Pat. No. 3,461,713 to Donath, which describes a pliers tool for restoring or freeing a deformed or jammed zipper. The device includes two jaws that curve inwardly toward each other, with each jaw being of a forked design. The Donath pliers are further provided with an adjustable gap stop for matching the jaw gap to the length of the zipper slide being repaired, however it lacks a compartment configured for the storage of needles and thread and its handle structure is divergent from that of the present invention.

Finally, U.S. Pat. No. 6,839,949 to Miknich describes a zipper repair tool having a pliers-like body with a head configured for the reception of a zipper head. The jaws have a base portion and a bifurcated upper portion including a tip designed to fit over the grooves of a zipper guide. As the tool is squeezed, the teeth are forced into the grooves in order to adjust the groves of zippers quickly and easily. While the zipper repair tool of Miknich is similar in nature and relevant to the present invention, it differs in that it fails to provide a compartment within the handle of the pliers-like device that is configured for the storage of a needle and thread that are used to repair the zipper.

The present invention provides a pliers-like tool that is utilized for repairing a zipper. The tool includes a pair of upper and lower pivotally connected handles that terminate in a jawed end comprising a forked section configured for the reception of a zipper head and blades configured for severing a zipper thread. The upper handle comprises a sunken area configured for reception of a thumb of a user, whereby the lower handle comprises a hinged section that comprises a storage compartment adapted for the reception of a needle and thread that can be used to facilitate repair of the zipper. The zipper repair tool of the present invention is distinguished from that of the prior art because the device incorporates all the equipment necessary to repair a zipper within its handle, and further includes a forked jaw and thread cutting blades.

In view of the drawbacks of the prior art devices, it is shown that the prior art has several known setbacks and that the present invention is substantially divergent in design elements from the prior art and subsequently it is clear that there is a need in the art for an improvement to existing zipper repair tools. In this regard the instant invention substantially fulfills these needs.

SUMMARY OF THE INVENTION

In view of the foregoing disadvantages inherent in the known types of zipper repair tools now present in the prior art, the present invention provides a new tool that can be utilized for repairing zippers wherein the same can be utilized for providing convenience for the user when a zipper repair tool is desired that comprises all the tools that are necessary for repairing a damaged zipper.

It is therefore an object of the present invention to provide a new and improved zipper repair device that has all of the advantages of the prior art and none of the disadvantages.

It is another object of the present invention to provide a zipper repair device resembling a pliers-like tool that includes a hinged compartment configured for the storage of a needle and thread.

Another object of the present invention is to provide a zipper repair device including pivotally connected handles that terminate in a jawed section A final object of the present invention is to provide a zipper repair device comprising jaw members configured for receiving a zipper head.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
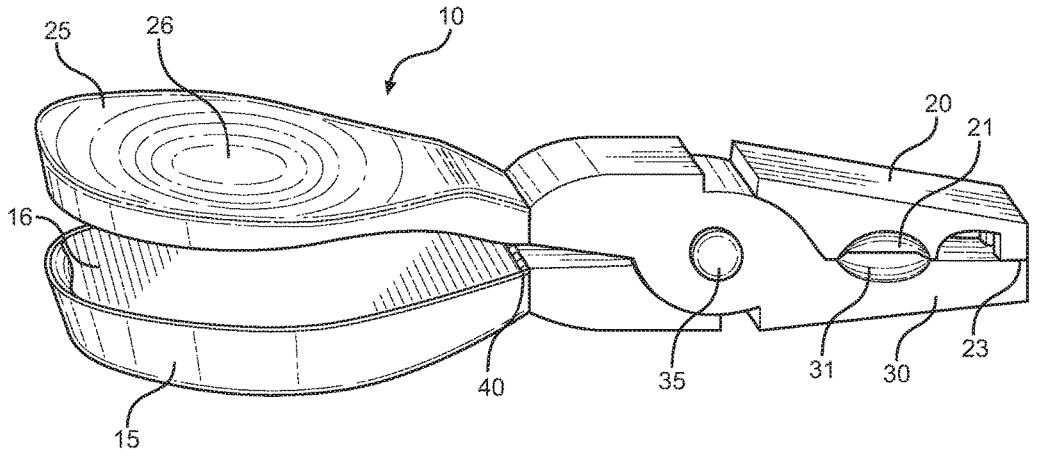
FIGS. 1A-1C show side and overhead views of the zipper repair device of the present invention.

Reference is made herein to the attached drawings. Like reference numerals are used throughout the drawings to depict like or similar elements of the zipper repair device. For the purposes of presenting a brief and clear description of the present invention, the preferred embodiment will be discussed as used for providing a means for storing all the necessary components required to repair a zipper within a zipper repair device. The figures are intended for representative purposes only and should not be considered to be limiting in any respect.

Figure 1B:
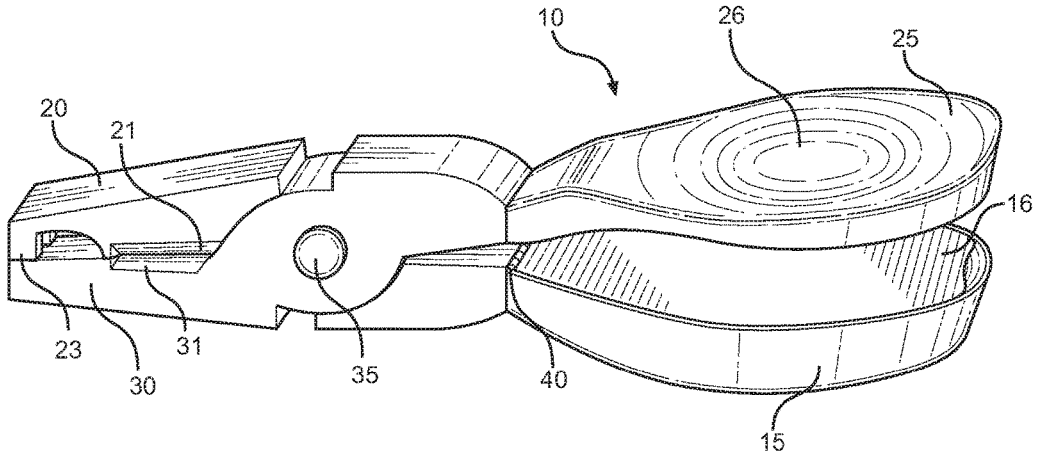
Figure 1C:
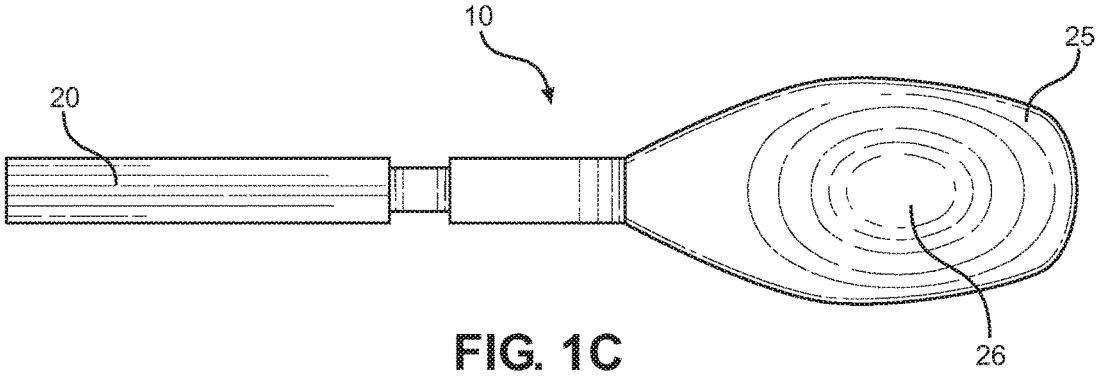

Referring now to FIGS. 1A-1C there are shown side and overhead views of the zipper repair device 10 of the present invention; whereby FIGS. 1A and 1B illustrate side views and FIG. 1C illustrates an overhead view of the device 10. The device 10 includes a pair of connected handles, comprised of a lower 15 and upper 25 handle that establish a plier-type or scissor type tool. The handles 15, 25 are securely attached at a pivot point 35, while the distal ends of each handle terminate in a pair of jaws 20, 30 that are configured for the reception of a zipper head and for use as a pair of cutting jaws.

The upper handle 25 crosses positions with the lower handle 15 at the pivot point 35, while the upper handle 25 terminates in a lower jaw 30 and the lower handle 15 terminates at an upper jaw 20. The upper jaw includes an upper blade 21 and the lower jaw 30 includes a planar surface thereon and a lower blade 31, wherein the lower blade 31 is adapted for severing a thread when the jaws are compressed together and the upper blade 21 crosses the lower blade 31 in a shearing motion. As shown in FIG. 1C, the upper handle 25 further comprises a sunken section 26 that is adapted to provide clearance for the upper and lower blades 21, 31, which are positioned along one side of each jaw and overlap one another to cut thread or other articles during a zipper repair.

Similar to the upper handle 25, the lower handle 15 crosses paths with the upper handle 25 at the pivot point 35. The lower handle 15 terminates at the upper jaw 20, wherein the upper jaw 20 includes a forked end 23 and the upper blade 21. The forked end 23 is bifurcated and adapted for the reception of a zipper head therein, while the upper blade 21 is configured to mate against or cross over the lower blade 31 in order to form shears or cutting blades. The upper and lower blades 21,31 enable the severing of thread or similar sized items therein, when the handles 15, 25 are pivoted towards each other. Additionally, the lower handle 15 includes a hinge 40, whereby the hinge 40 facilitates the opening of a compartment door within the handle proximal end. Under the compartment door is a storage compartment for storing needles, thread, and other garment and zipper repair items.

Figure 2A:
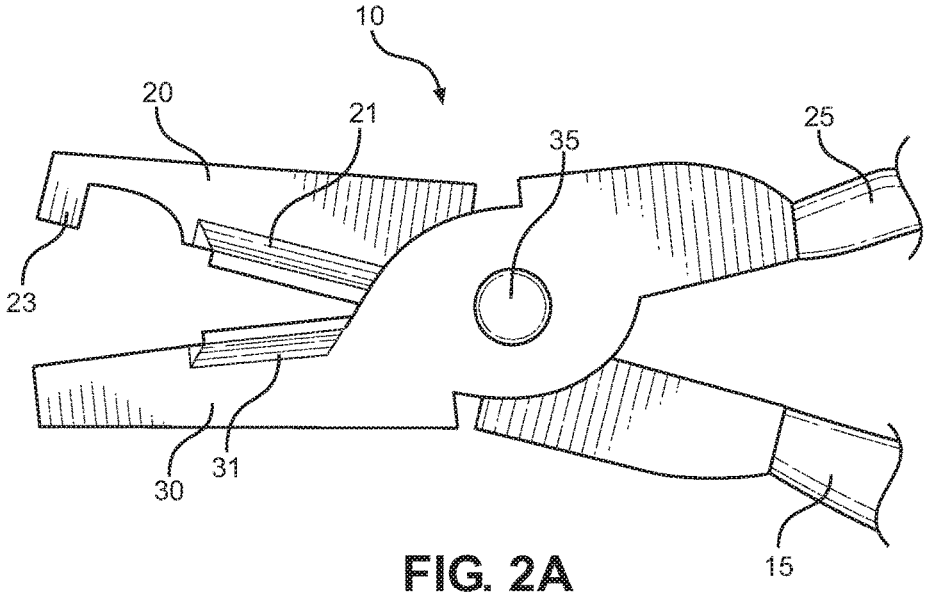
FIGS. 2A-2C show side and perspective views of the opened jaws of the zipper repair device of the present invention.
Figure 2B:
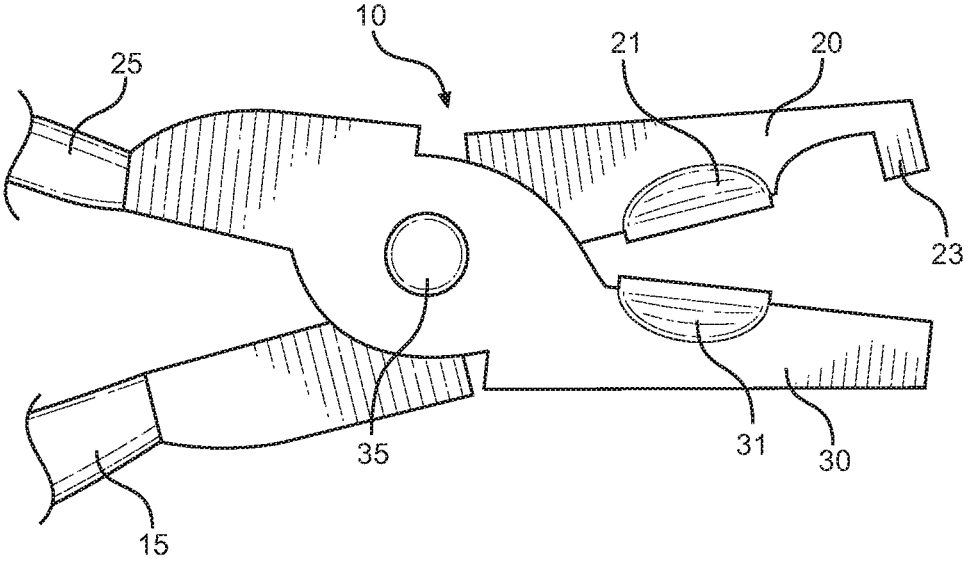
Figure 2C:
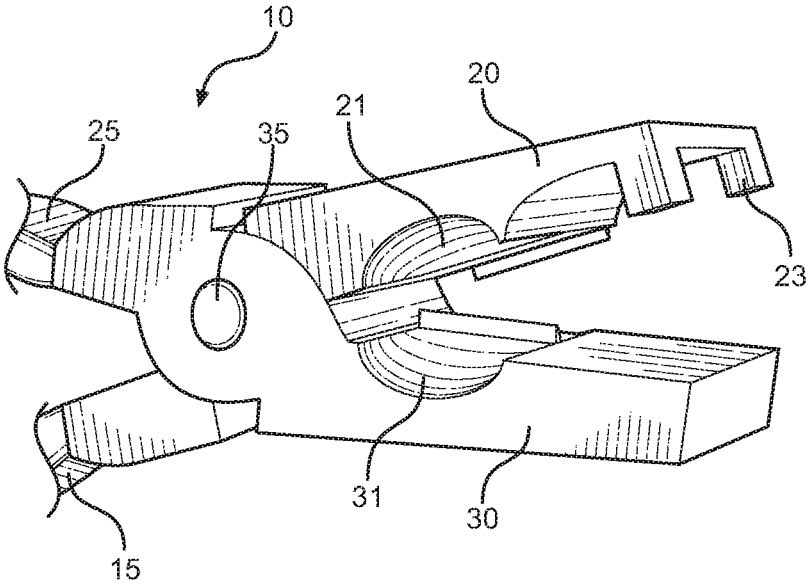

Referring now to FIGS. 2A-2C there are shown side and perspective views of the opened jaws of the zipper repair device of the present invention, whereby FIGS. 2A and 2B display the side views and FIG. 2C illustrates the perspective view of the present invention. The upper and lower jaws 20, 30 are opened by actuation of the lower 15 and upper 25 handles away from each other, which results in the handles rotating about the pivot point 35. The upper jaw 20 is located at the end of the lower handle 15 and includes the forked end 23 configured for receiving a zipper head, and the upper blade 21 adapted for cutting a thread. The lower jaw 30 is located at a distal end of the upper handle 25 and includes a tapered jaw section and the lower blade 31 adapted to mate or overlap with the upper blade 21 of the lower handle 15, whereby the meeting of the upper and lower blades 21, 31 is used for cutting or severing zipper threads. As shown in the perspective view of FIG. 2C, the upper jaw 20 comprises the forked end 23 adapted for the reception of a zipper head therebetween.

Figure 3A:
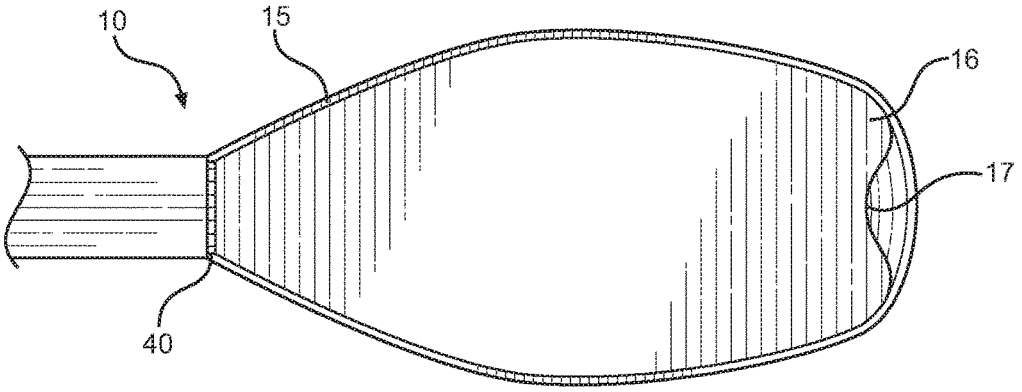
FIGS. 3A-3C show overhead and internal views of the lower handle portion of the zipper repair device of the present invention, and notably the compartment therein.
Figure 3B:
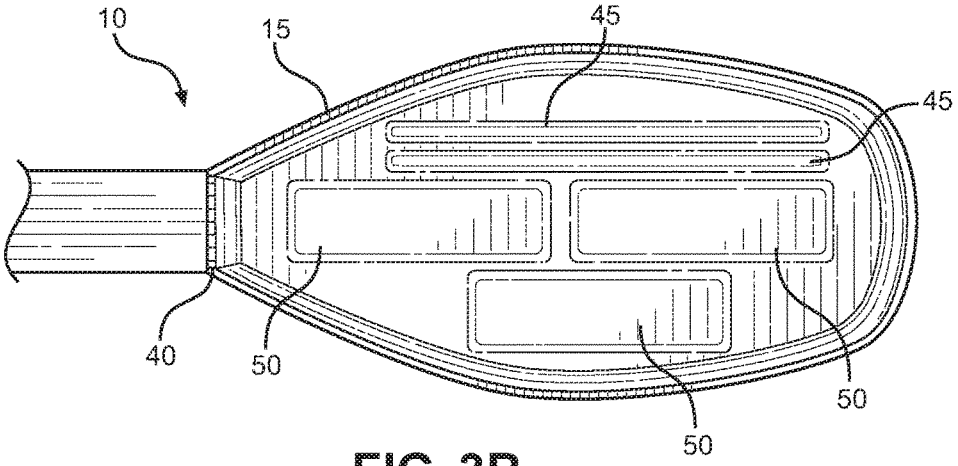
Figure 3C:
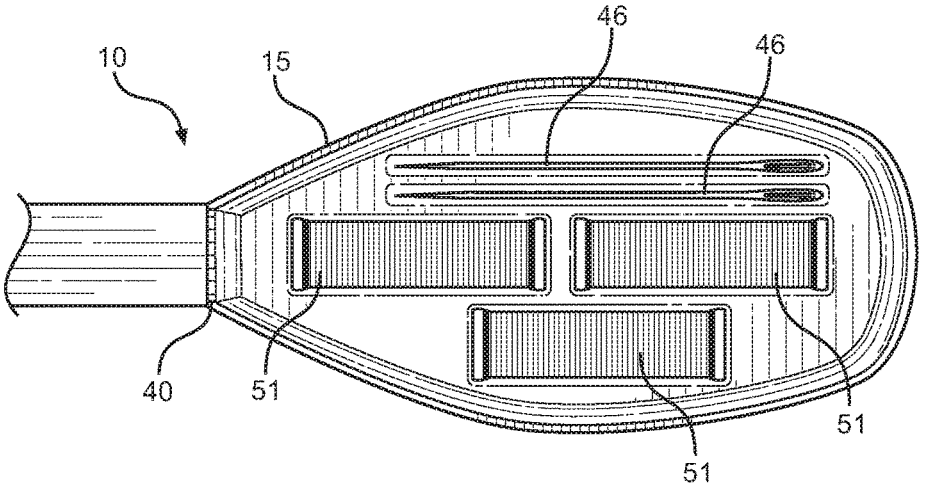

Referring to FIGS. 3A-3C there are shown overhead and internal views of the lower handle 15, wherein FIG. 3A shows the overhead view, FIG. 3B shows the sunken compartments within the handle 15, and FIG. 3C illustrates the internal components within the lower handle 15.

Referring now to FIG. 3A, there is shown an overhead view of the lower handle 15 of the zipper repair tool 10 of the present invention. The lower handle 15 includes a removable top portion 16 that is hingedly attached to the lower handle 15, whereby the top portion 16 comprises a cutout 17 that can be lifted to facilitate the opening of the top portion 16 away from the lower handle 15.

FIG. 3B illustrates an overhead view of the lower handle 15, wherein the top portion 16 is remove to better illustrate the internal views of the lower handle 15. Within the lower handle 15, there are shown a plurality of sunken internal sections 45 and 50, whereby sunken sections 45 are configured for reception of needles and sunken sections 50 are configured for the reception of a plurality of threads.

Referring now to FIG. 3C, there is shown a view of the components within the sunken sections 45 and 50 of FIG. 3B. As shown the sunken sections 45 and 50 are sized and configured for the reception of 46 and thread 51 within sections 45 and 50 as shown in FIG. 3B, respectively.

Figure 4:
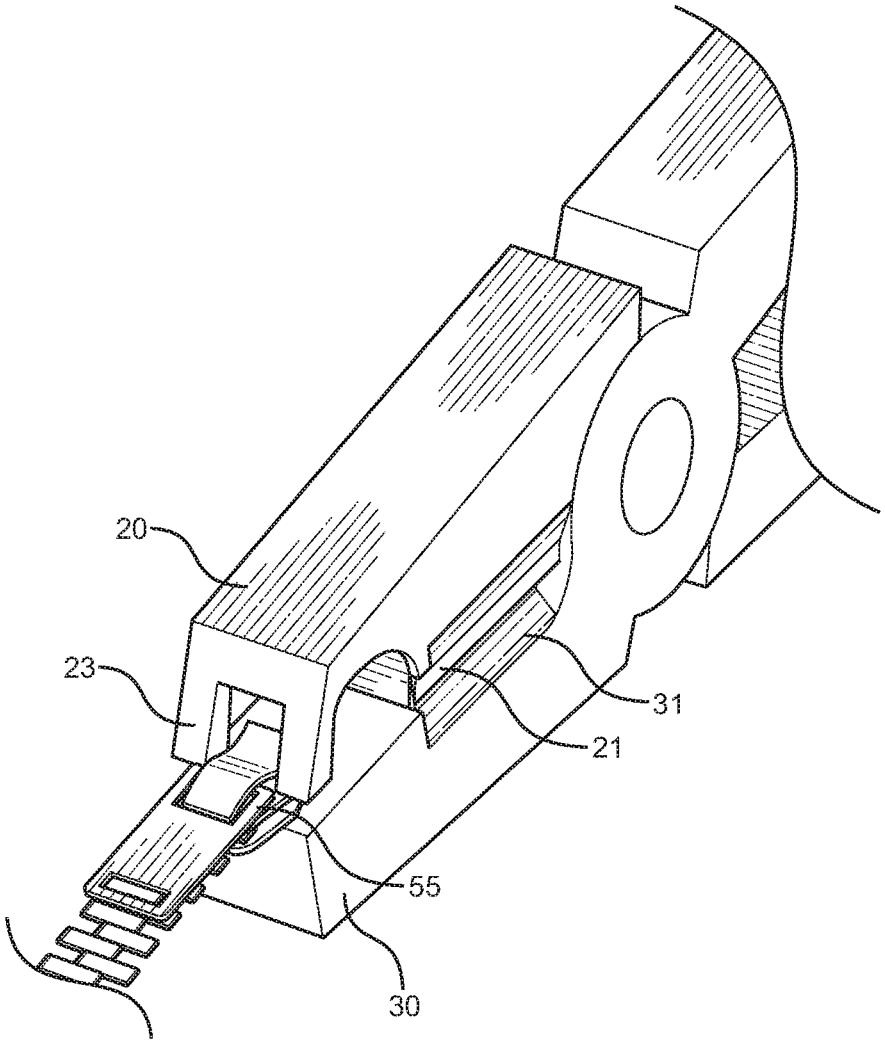
FIG. 4 shows a view of the present invention while in use repairing a zipper head.

Referring now to FIG. 4, there is shown a view of the zipper repair tool of the present invention while in use. In use, the zipper repair tool 10 is adapted to replace a loosened or damaged zipper head 55. The device resembles a pair of pliers, wherein the device 10 is capable of retaining a zipper head 55 within the bifurcated portion 23 of the upper jaw 20. In order to replace the zipper head 55, a user may clamp the bifurcated portion 23 of the upper jaw 20 down onto the surface of the zipper head. The user may then either tighten down on the zipper head 55 to further secure the zipper head 55, or apply the use of the needle and thread to secure or replace the zipper head 55.

As shown in this preferred embodiment, the zipper repair tool 10 of the present invention includes a pair of lower 15 and upper handles 25 that extend and terminate at upper 20 and lower jaws 30 respectively, whereby the upper 25 and lower 15 handles cross each other at a pivot point 35 on the device 10. The upper handle 25 includes a recessed area 26 adapted for the reception of a user's thumb and terminates in a lower tapered jaw 30. The lower handle 15, includes a top portion 16 that is hingedly attached 40 to the lower handle 15, whereby the top portion 16 can be lifted by the pulling up on the cutout 17 of the top portion 16. When removed, the top portion 16 reveals a compartment within the lower handle 15 that includes sunken sections 45 and 50 that are configured for the reception of a pair of needles 46 and a set of three threads 51. It is contemplated that the sewing kit 46, 51, can be utilized for repairing torn or frayed material. Additionally, the zipper repair tool 10 of the present invention includes a pair of blades 21, 31 that mate and form scissors adapted for the use of cutting the threads.

The present invention is designed for those who wish to preserve their clothing. The zipper repair device 10 includes a pair of lower 15 and upper handles 25; wherein the interior compartment of the lower handle includes sunken areas 45, 50 configured for the reception of needles 46 and thread 51. The storage compartments 45, 50, can comprise different sizes of needles and differing sizes and colors of thread. Moreover, there may be differing amounts of sections capable of retaining the needle and thread. Furthermore, there may be different sized jaw members and bifurcated 23 portions to accommodate different sized zipper heads 55. In this way, the present invention provides a tool that can be used to fix a loose zipper, as well as repair torn or frayed clothing.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A zipper repair tool, comprising:

an upper handle having a recessed proximal region adapted for the reception of a user's thumb;

a lower handle having a proximal end compartment therein, said proximal end compartment comprising a first plurality of sunken sections each configured to receive a sewing needle and a second plurality of sunken sections each configured to receive a spool of thread;

a lower tapered jaw section including a flat section, whereby said lowered tapered jaw section is disposed at a distal end of said upper handle;

an upper jaw having a bifurcated tip portion adapted for the reception of a zipper head, whereby said upper jaw is disposed at a distal end of said lower handle; a pivot point, whereby the upper and lower handles are pivotally attached to each other; an upper blade disposed on the upper jaw; a lower blade disposed on the lower tapered jaw section; and wherein said upper and lower blades form cutting shears configured to cross each other in a scissor action between an open and closed positon where the bifurcated tip portion engages the flat section in the closed position.

2. The zipper repair tool of claim 1, wherein said distal end of said lower tapered jaw section opposing said bifurcated tip portion of said upper jaw comprises a planar surface forward of said lower blade of said lower tapered jaw section.

3. The zipper repair tool of claim 1, further comprising a compartment door, the compartment door being hingedly attached to the proximal end compartment and configured to cover the first plurality of sunken sections and the second plurality of sunken sections of the proximal end compartment.

4. The zipper repair tool of claim 1, wherein the closed position includes the bifurcated tip portion of the upper jaw resting flush against the flat section of the lower tapered jaw section.

* * * * *